US005483736A

United States Patent [19]

Ohnishi

[11] Patent Number: 5,483,736

[45] Date of Patent: Jan. 16, 1996

[54] METHOD OF MANUFACTURING A CORNER HEAD TYPE THERMAL HEAD

[75] Inventor: Hiroaki Ohnishi, Kyoto, Japan

[73] Assignee: Rohm Co., Ltd., Kyoto, Japan

[21] Appl. No.: 255,312

[22] Filed: Jun. 3, 1994

[30] Foreign Application Priority Data

Jun. 8, 1993 [JP] Japan ..... 5-137955
Jun. 22, 1993 [JP] Japan ..... 5-149937

[51] Int. Cl.[6] ..... H05B 3/00; B26D 3/06

[52] U.S. Cl. ..... 29/611; 29/412; 83/875; 347/201

[58] Field of Search ..... 29/611, 412; 83/875, 83/877; 347/201

[56] References Cited

U.S. PATENT DOCUMENTS 4,968,996 11/1990 Ebihara .
5,077,564 12/1991 Thomas .

FOREIGN PATENT DOCUMENTS 0395001 10/1990 European Pat. Off. .
0398582 11/1990 European Pat. Off. .
0497551 8/1992 European Pat. Off. .
0497551A1 8/1992 European Pat. Off. .
0523884 1/1993 European Pat. Off. .
62-11764 5/1987 Japan .
62-124962 6/1987 Japan .
62-267564 4/1988 Japan .
4-46929 5/1992 Japan .
04039064 5/1992 Japan .
04169247 6/1992 Japan .

OTHER PUBLICATIONS

European Search Report dated 30 Sep. 1994.

*Primary Examiner*—P. W. Echols
*Attorney, Agent, or Firm*—Fish & Richardson

[57] ABSTRACT

A slope is provided from a heater area to the side of the edge of a substrate near the heater area. A resistance film layer and a common electrode are provided on the slope which is formed as a convexly curved surface. In the slope, a reinforcement conductor along the common electrode is embedded below the resistance film layer.

2 Claims, 20 Drawing Sheets

METHOD OF MANUFACTURING A CORNER HEAD TYPE THERMAL HEAD

BACKGROUND OF THE INVENTION

1. Field of the Invention

This invention relates to a thermal head and more particularly to a corner head type thermal head improved in printing efficiency and a manufacturing method therefor.

2. Description of the Related Art

In using a thermal head, it is necessary to concentrate pressure on a ribbon, print paper, and a platen in a heater area for supporting print on rough paper and improving printing efficiency.

For this purpose, hitherto, a near edge type thermal head with a heater area provided near the edge of the thermal head has been installed so as to be inclined against a platen for concentrating pressure against a ribbon and print paper on the heater area and its vicinity. Such a near edge type thermal head is disclosed, for example, in Japanese Utility Model Publication No. Hei 4-46929. An example of the head is shown in FIGS. 30 and 31.

FIG. 30 shows a sectional view of the near edge type thermal head, wherein a glaze layer is formed on a substrate 10 and a resistance film layer 12, electrodes 14 and 15, and a protective film are provided thereon.

To use the thermal head, print paper 30 is placed under a platen 51 and from under the print paper, a ribbon 31 is pressed onto the print paper 30 by the thermal head 50, as shown in FIG. 31. At this time, the thermal head 50 is supported by a carriage so that it is inclined against the platen 51. As shown in FIG. 30, a slope 18 constituted by a part of the glaze layer 11 and a part of the substrate 10 is formed on the edge of the thermal head 50 for facilitating passage of the ribbon 31 when the thermal head 50 is inclined. However, the intersecting part 55 of the slope 18 and the top surface of the glaze layer 11, namely, the corner part 55 is not applied on a heater area 13.

The near edge type thermal head has a heater part having a small curvature and the heater area formed so as not to lie across the corner part 55, thus the inclination angle of the thermal head against the platen 51 cannot be made large. The angle is from several degrees to less than 10 degrees at most. Therefore, concentration of pressure on the ribbon and print paper cannot be made so high with the result that printing efficiency is insufficient and a good print on rough paper cannot be provided.

To solve the problem, a corner head type thermal head is used with the above-mentioned corner part formed in a glaze layer located near the edge of the thermal head and a heater area formed so as to lie across the corner part. Examples of such a corner head type thermal head are shown in FIGS. 32 and 33(*a*),(*b*).

FIG. 32 shows a sectional view of an example of the conventional corner head type thermal head, wherein a glaze layer 11 is formed on a substrate 10 and a resistance film layer 12 is formed on the glaze layer 11. The glaze layer 11 in the example is of partial glaze type and has the sectional form like a mountain. A heater area 13 with a predetermined part generating heat when the print operation is performed is formed on the top of the mountain. A slope 18 is provided from the heater area 13 to the side 17 of the substrate 10 edge near the heater area 13. A common electrode 15 is provided on the slope 18. A discrete electrode 14 for supplying a current to the predetermined part of the heater area 13 in conjunction with the common electrode 15 is formed in an area on the resistance film layer 12, the area facing the common electrode 15 with the heater area 13 between. In the example, current flows from the common electrode 15 via the resistance film layer 12 of the heater area 13 into the discrete electrode 14.

As seen in FIG. 32, the slope 18 ends on the side of the glaze layer 11, namely, the corner part 55 is formed so as to be applied on the heater area 13. Therefore, the heater area 13 is formed so as to lie across the corner part 55.

A protective film 16 is formed on the top layer.

FIGS. 33(*a*),(*b*) show another example of the conventional corner head type thermal head. Parts identical with or similar to those previously described with reference to FIG. 32 are denoted by the same reference numerals in FIGS. 33(*a*),(*b*) and will not be discussed again.

FIG. 33(*a*) shows a sectional view of the thermal head in the example. A discrete electrode 14 and a common electrode 15 are provided on the same side with respect to a heater area 13 and a turned common electrode 45 is provided facing the discrete electrode 14 and the common electrode 15 with the heater area 13 between.

Their arrangement is shown as a partial plan view in FIG. 33 (*b*), wherein supply voltage is supplied to the common electrodes 15 and current flows into the discrete electrodes 14 via the heater area 13 and the turned common electrodes 45.

Next, FIG. 34 shows a use example of the conventional corner head type thermal head.

In FIG. 34, the corner head type thermal head 50 is installed so as to be inclined against a platen 51 for concentrating pressure against a ribbon 31 and print paper 30 on the heater area 13. In the example, the inclination angle of the corner head type thermal head can be made larger than that of the near end type thermal head; normally, it can be set to about 10 degrees to 35 degrees. The curvature of the heater part of the corner head type thermal head can also be made larger than that of the near end type thermal head. Thus, the concentration of pressure is raised, improving the printing efficiency.

However, since the slope 18 is flat, the intersecting part 20 of the side of the thermal head and the slope 18 has a corner. The curvature of the heater part becomes large, the head sinks into the ribbon 31 and print paper 30 deeply, and the inclination angle increases, so that the intersecting part 20 approaches the ribbon 31, etc., compared with the near edge type thermal head.

Thus, the ribbon 31 is in sliding contact with the top of the intersecting part 20 and is worn or cut. Dirty print occurs on print paper 30 because of powder from the ribbon 31.

Further, if thermosensible paper is used as print paper 30, it is also in sliding contact with the top of the intersecting part 20, causing pressure rubbing of the paper, so that it causes a mark.

In the example of the conventional corner head type thermal head shown in FIG. 32, the width of the slope 18, L, is about 200 μm. Therefore, the width of the common electrode 15 formed in the part is limited to 200 μm or less. If the common electrode 15 is made thicker, a disadvantage such as catching of the ribbon occurs and the thickness is also limited. Thus, if the heater area is lengthened or the number of heaters is increased in the conventional corner head type thermal head, the resistance value of the common electrode 15 becomes large and the voltage drop at the parts far from the part to which supply voltage is supplied becomes large, degrading the printing quality.

On the other hand, in the example of the conventional corner head type thermal head shown in FIG. 33, a power supply is connected to each of the common electrodes 13 individually, thus the voltage drop can be reduced and the problem in the example in FIG. 32 can be dealt with.

However, in the example shown in FIG. 33, the substantial area of the heater area 13 corresponding to one picture element becomes twice that in the example shown in FIG. 32; the corner head type thermal head in the example shown in FIG. 33 is not applicable to an application where a fine pattern is required.

SUMMARY OF THE INVENTION

It is therefore an object of the invention to provide a corner head type thermal head to prevent dirty printing and wearing and cutting of a ribbon without losing the advantages of a corner head and a large corner head type thermal head to reduce the resistance value of common electrodes and maintain low costs in order to allow the containing of a large number of heaters.

To these ends, according to the invention, there is provided a corner head type thermal head comprising a glaze layer provided on a substrate, a slope formed from a predetermined position on the top face of the glaze layer to the substrate side, a convex corner part formed by intersection of the slope and the top face of the glaze layer, a resistance film layer provided on the slope and on the glaze layer, a heater area formed lying across the top of the corner part, a common electrode provided on the resistance film layer in the slope area, and a discrete electrode provided on the resistance film layer in an area facing the common electrode with the heater area between for causing a current to flow into a predetermined portion of the heater area in association with the common electrode, wherein at least the intersecting part of the slope and the substrate side is formed as a convexly curved surface.

The full face of the slope may be formed as a convexly curved surface.

According to the invention, there is provided a corner head type thermal head comprising a glaze layer provided on a substrate, a slope formed from a predetermined position on the top face of the glaze layer to the substrate side, a convex corner part formed by intersection of the slope and the top face of the glaze layer, a resistance film layer provided on the slope and on the glaze layer, a heater area formed lying across the top of the corner part, a common electrode provided on the resistance film layer in the slope area, and a reinforcement conductor provided so that the resistance film layer is sandwiched between the reinforcement conductor and the common electrode in the slope area, a discrete electrode provided on the resistance film layer in an area facing the common electrode with the heater area between for causing a current to flow into a predetermined portion of the heater area in association with the common electrode and the reinforcement conductor.

At least the intersecting part of the slope and the substrate side may be formed as a convexly curved surface.

The full face of the slope may be formed as a convexly curved surface.

According to the invention, there is provided a method of manufacturing a corner head type thermal head, comprising the steps of forming a glaze layer on a substrate, preparing a cutting blade having a slant part with at least the vicinity of the nose formed as a concavely curved surface, half cutting the glaze layer and the substrate with the cutting blade downward from a predetermined position on the top surface of the glaze layer for forming a groove one side of which forms a slope being constituted of said glaze layer and said substrate, said slope being formed as a convexly curved surface in at least a vicinity of a bottom of said groove, heat-treating the substrate and the glaze layer, forming a resistance film layer, a common electrode, a discrete electrode, and a protective film on the glaze layer and on the slope, and cutting the substrate on both sides of the groove.

The entire slant part of the cutting blade may be formed as a concavely curved surface.

According to the invention, there is provided a method of manufacturing a corner head type thermal head, comprising the steps of forming a glaze layer on a substrate, half cutting an area containing a part of the glaze layer downward from the top surface of the glaze layer for forming a groove, embedding a conductor in the groove, and preparing a cutting blade having a slant part;

half cutting the glaze layer and the substrate with the cutting blade downward from a predetermined position on the top surface of the glaze layer for forming a slope with a part of the conductor left from the glaze layer to the substrate, heat-treating the substrate and the glaze layer, forming a resistance film layer, a common electrode, a discrete electrode, and a protective film on the glaze layer and on the slope, and cutting the substrate on both sides of a groove having the slope as one side.

The slant part may be formed as a concavely curved surface at least in the vicinity of the nose of the cutting blade having the slant part.

The full face of the slant part of the cutting blade may be formed as a concavely curved surface.

According to the invention, the entire slope provided from the heater area of the thermal head to the side of the end face of the substrate or the intersecting part of the slope and the substrate side is formed as a convexly curved surface, so that if a ribbon is in sliding contact with the slope, the ribbon is not worn or cut.

A reinforcement conductor is embedded along the common electrode below the resistance film layer of the slope, thus the total resistance value of the common electrode and the reinforcement conductor is reduced because the common electrode and the reinforcement conductor work in association with each other.

BRIEF DESCRIPTION OF THE DRAWINGS

In the accompanying drawings:

FIG. 17(*b*) is a sectional view of a corner head type thermal head of full glaze type according to the invention;

FIG. 18 (*b*) is a sectional view of a corner head type thermal head manufactured by the method of FIG. 18(*a*);

FIG. 33(*b*) is a plan view of another example of the conventional corner head type thermal head.

DESCRIPTION OF THE PREFERRED EMBODIMENTS

Referring now to the accompanying drawings, there are shown preferred embodiments of the invention.

First Embodiment

Figure 1:
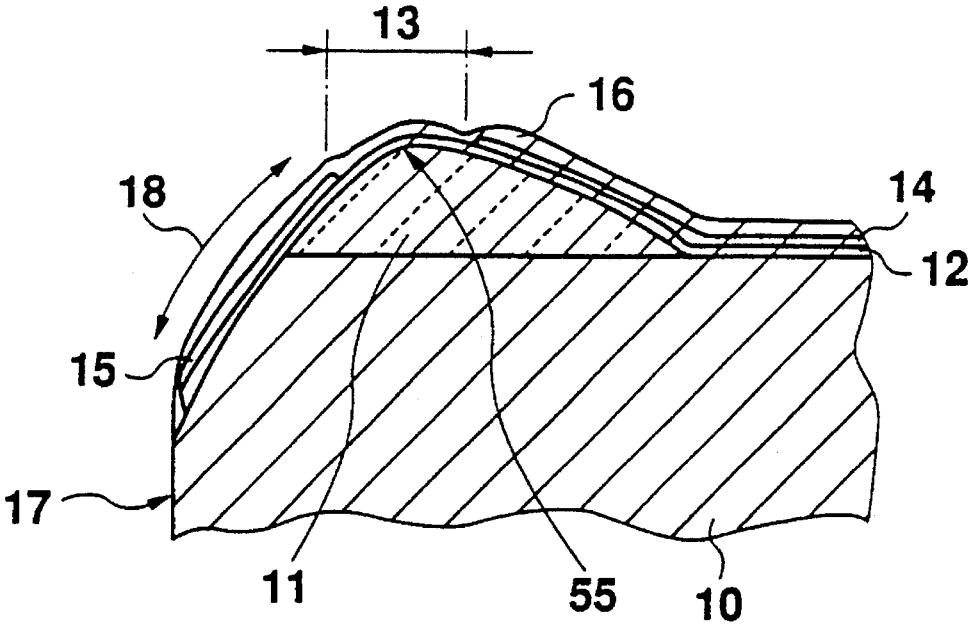
FIG. 1 is a sectional view of a corner head type thermal head according to a first embodiment of the invention.
Figure 32:
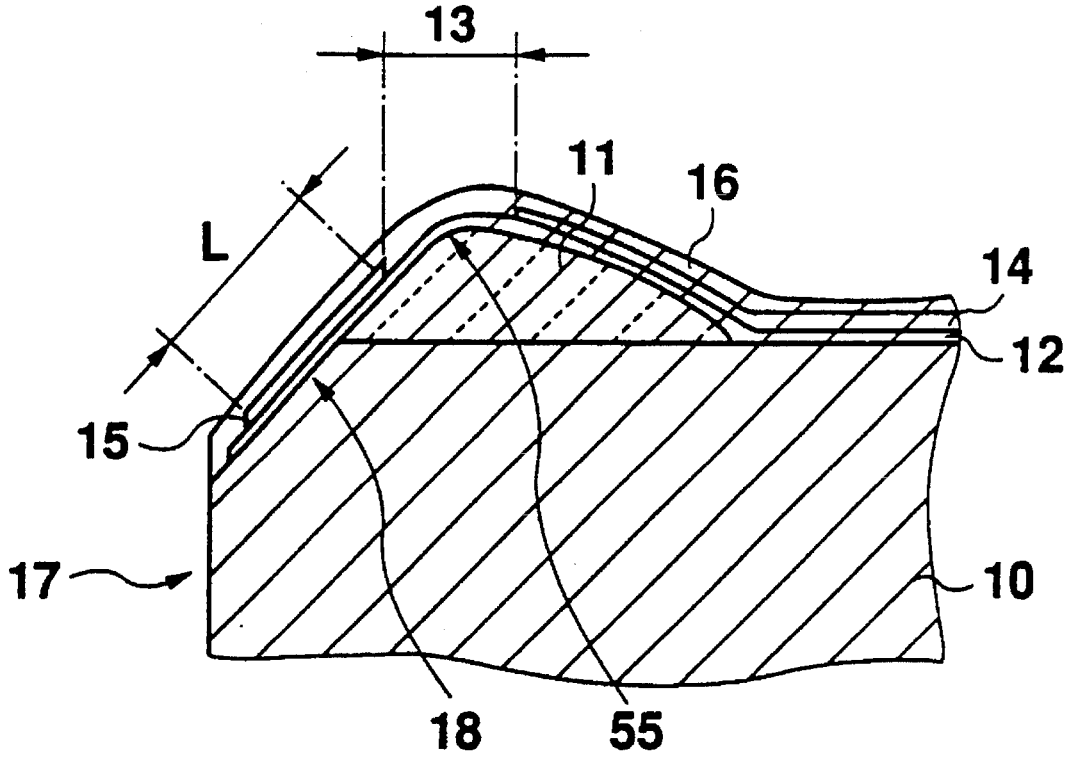
Fig. 32 PRIOR ART
FIG. 32 is a sectional view of an example of a conventional corner head type thermal head.
Figure 33A:
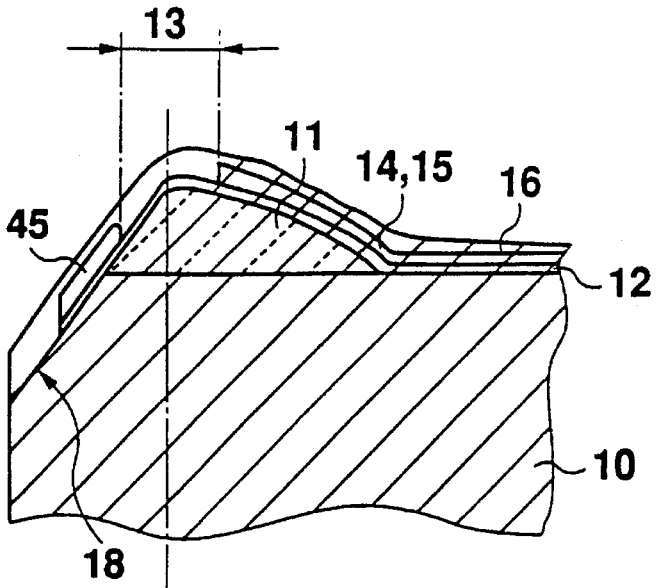
Fig. 33(a) PRIOR ART
FIG. 33(*a*) is a sectional view of another example of the conventional corner head type thermal head.
Figure 33B:
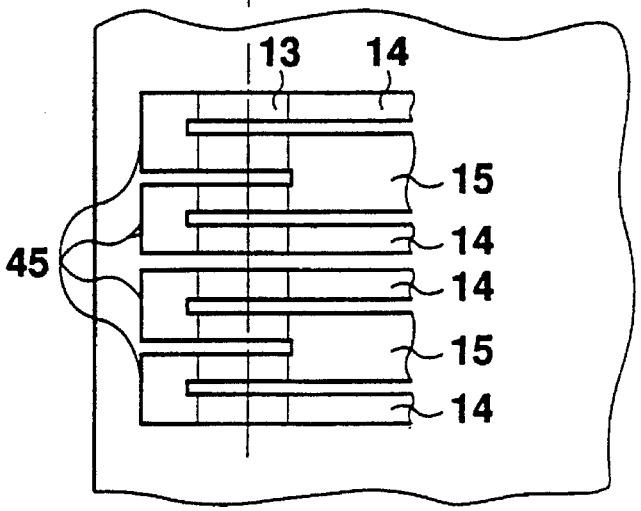
Fig. 33(b) PRIOR ART
Figure 34:
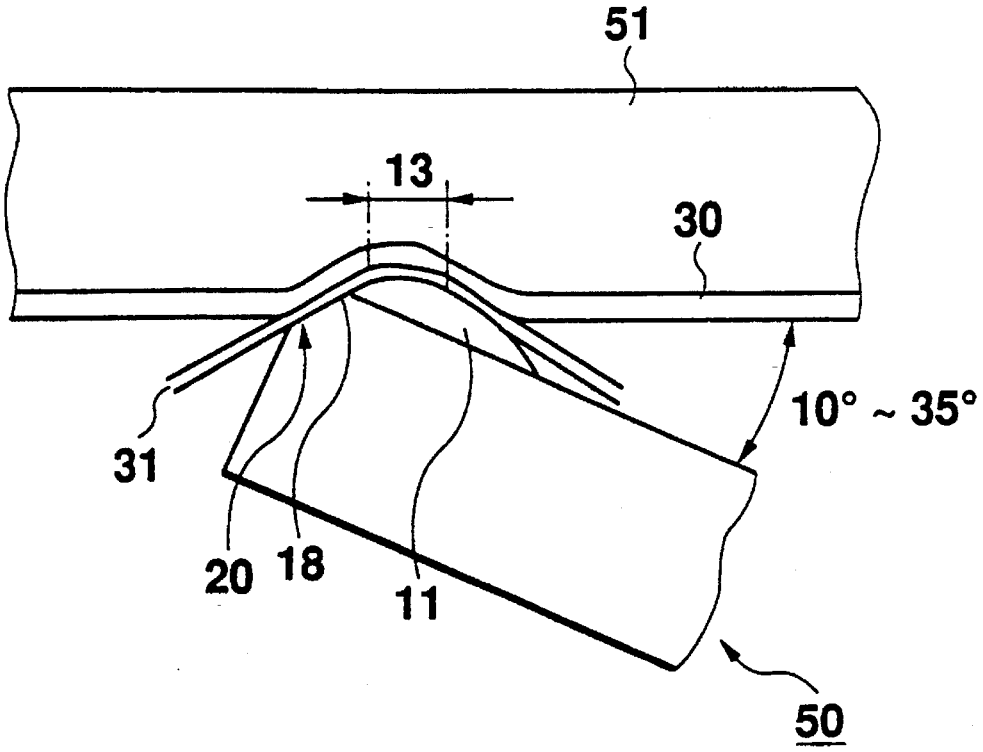
Fig. 34 PRIOR ART
FIG. 34 is an illustration of a printing mechanism of a printer using the conventional corner head type thermal head.

FIG. 1 shows a sectional view of a first embodiment of the invention. Parts identical with or similar to those previously described with reference to FIGS. 32–34 are denoted by the same reference numerals in FIG. 1.

In FIG. 1, a glaze layer 11 is formed near the end face on a substrate 10 and a resistance film layer 12 is formed on the glaze layer 11. The glaze layer 11 in the embodiment has the sectional form like a mountain. A discrete electrode 14 and a common electrode 15 are provided at a given interval to form a heater area 13 on the top of the mountain shaped portion, namely, the corner part 55. The resistance film layer 12, the discrete electrode 14, and the common electrode 15 are covered with a protective film 16.

The embodiment shown in FIG. 1 is characterized by the fact that a slope 18 is formed from the mountain top (corner part 55) in the heater area 13 to the side 17 of the end face of the substrate 10 and that the entire slope 18 is formed as a convexly curved surface.

Second Embodiment

Figure 2:
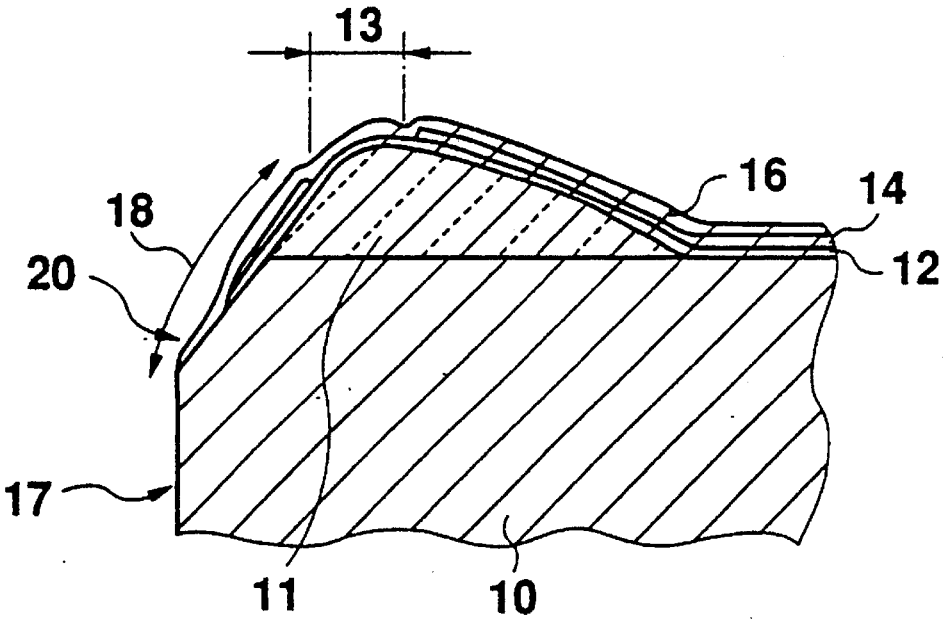
FIG. 2 is a sectional view of a corner head type thermal head according to a second embodiment of the invention.

FIG. 2 shows a sectional view of a second embodiment of the invention. Parts identical with or similar to those previously described with reference to FIG. 1 are denoted by the same reference numerals in FIG. 2 and will not be discussed again.

The embodiment shown in FIG. 2 is characterized by the fact that an intersecting part 20 of a slope 18 from a heater area 13 to the side 17 of a substrate 10 and the side 17 is formed as a convexly curved surface.

As described above, in the first and second embodiments shown in FIGS. 1 and 2, the entire slope 18 or the intersecting part 20 of the slope 18 and the side 17 is formed as a convexly curved surface, so that if a ribbon is in sliding contact with the portion, the ribbon is not worn or cut.

Third Embodiment

Figure 3:
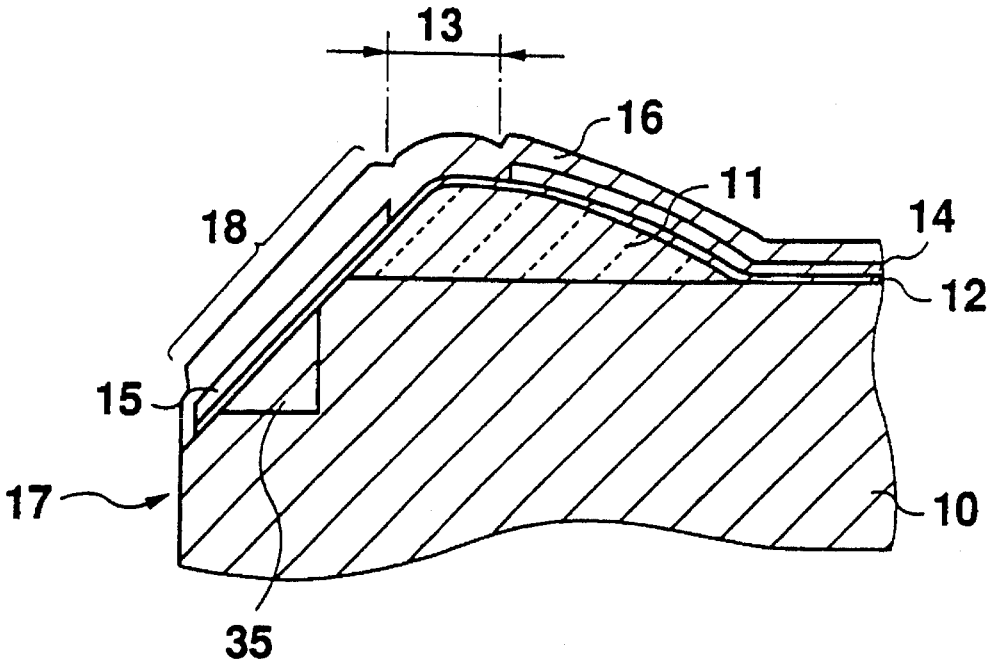
FIG. 3 is a sectional view of a corner head type thermal head according to a third embodiment of the invention.

FIG. 3 shows a sectional view of a thermal head according to a third embodiment of the invention. Parts identical with or similar to those previously described with reference to FIGS. 32–34 are denoted by the same reference numerals in FIG. 3 and will not be discussed again.

In FIG. 3, a slope 18 is formed from a heater area 13 to the side 17 of a substrate 10, as with the conventional thermal head examples. A resistance film layer 12 is formed on the slope 18 and a common electrode 15 is provided on the resistance film layer 12. In the slope 18, a reinforcement conductor 35 along the common electrode 15 is embedded below the resistance film layer 12. That is, the resistance film layer 12 is sandwiched between the common electrode 15 and the reinforcement conductor 35, and each of the common electrode 15 and the reinforcement conductor 35 is in electric contact with the resistance film layer 12.

The invention is characterized by the fact that the reinforcement conductor 35 along the common electrode 15 is embedded in the slope 18 as described above, whereby power can be supplied to the heater area 13 by the common electrode 15 and the reinforcement conductor 35 in association with each other. Therefore, the overall electrical resistance of the common electrode 15 and the reinforcement conductor 35 is lowered, so that the voltage drop at the common electrode 15 can be decreased drastically.

As described above, the effect of lowering the electrical resistance of the common electrode part can be accomplished by installing the reinforcement conductor 35 near the common electrode 15. Other embodiments of the invention for producing a similar effect to that of the embodiment shown in FIG. 3 will be described.

Fourth Embodiment

Figure 4:
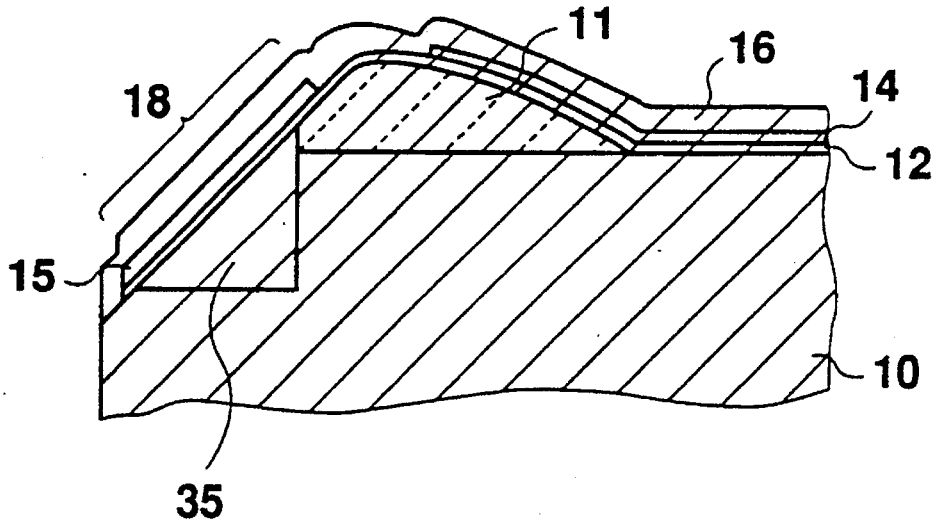
FIG. 4 is a sectional view of a corner head type thermal head according to a fourth embodiment of the invention.

A fourth embodiment of the invention shown in FIG. 4 is an example in which a reinforcement conductor 35 embedded in a slope 18 reaches not only a substrate 10, but also a glaze layer 11, whereby the reinforcement conductor 35 can be formed in a wider area.

Fifth Embodiment

Figure 5:
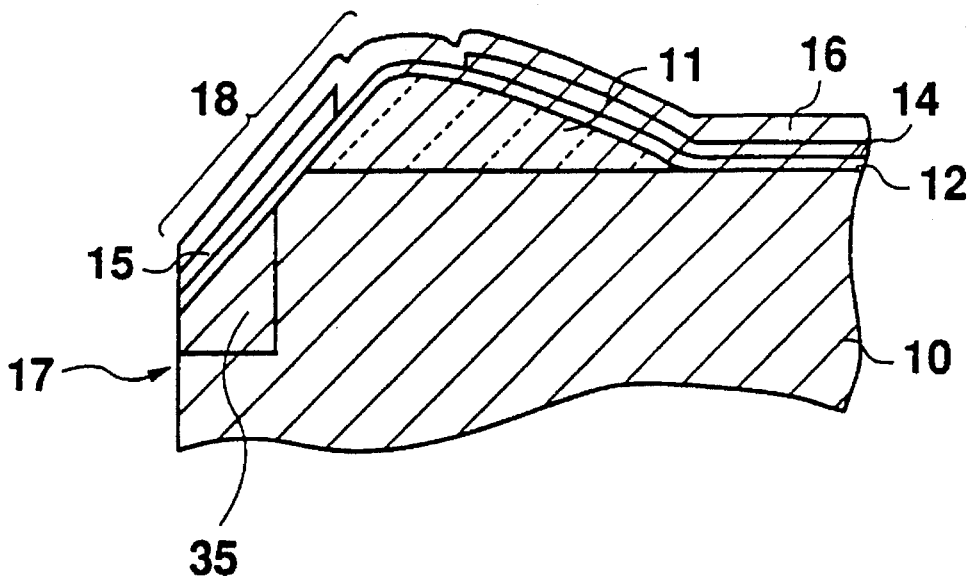
FIG. 5 is a sectional view of a corner head type thermal head according to a fifth embodiment of the invention.

A fifth embodiment of the invention shown in FIG. 5 is an example in which a reinforcement conductor 35 embedded in a slope 18 reaches the side 17 of a substrate 10.

Sixth Embodiment

Figure 6:
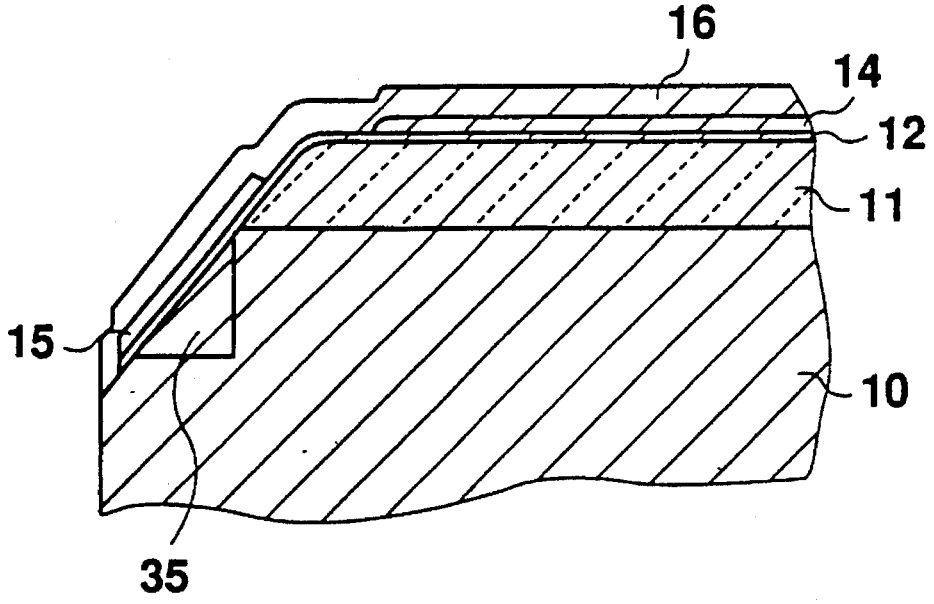
FIG. 6 is a sectional view of a corner head type thermal head according to a sixth embodiment of the invention.

A sixth embodiment of the invention shown in FIG. 6 is almost the same as the third embodiment shown in FIG. 3 except that the glaze layer is of a full glaze type.

Seventh Embodiment

Figure 7:
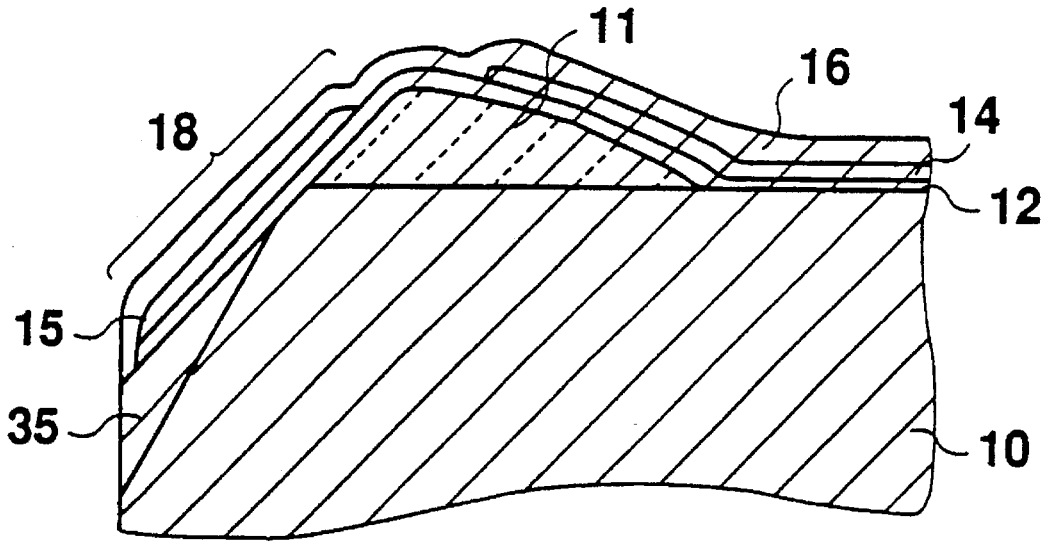
FIG. 7 is a sectional view of a corner head type thermal head according to a seventh embodiment of the invention.

A seventh embodiment of the invention shown in FIG. 7 is an example in which the sectional form of a reinforcement conductor 35 differs.

Eighth Embodiment

Figure 8:
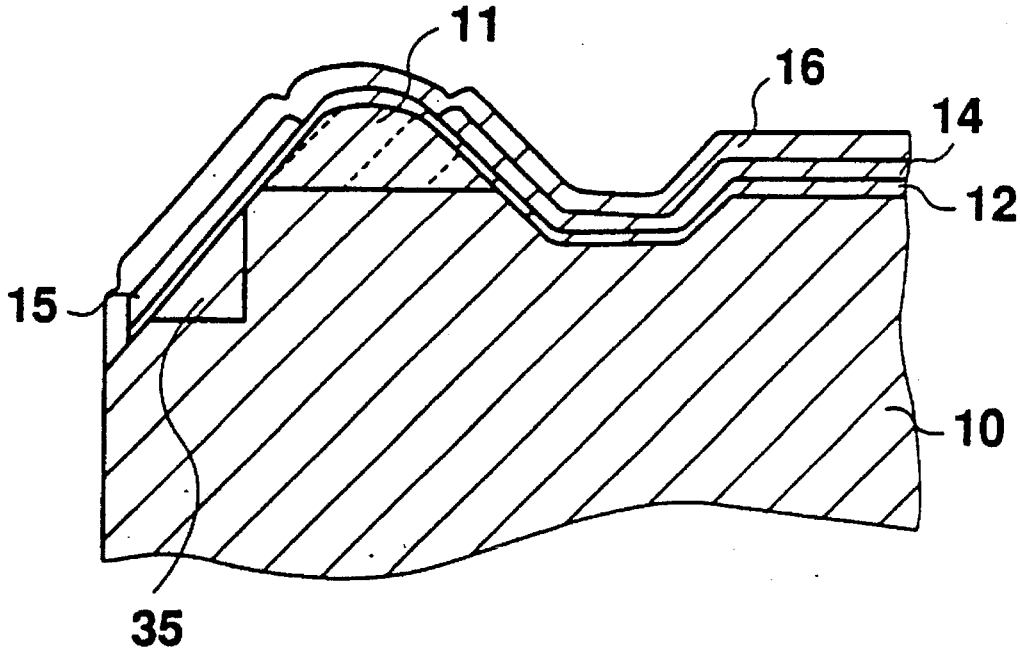
FIG. 8 a sectional view of a corner head type thermal head according to an eighth embodiment of the invention.

An eighth embodiment of the invention shown in FIG. 8 differs slightly from the embodiment shown in FIG. 3 in the sectional form of thermal head; a reinforcement conductor 35 in the eighth embodiment is similar to that shown in FIG. 3.

The embodiments shown above can be selected according to the application of the thermal heads.

Ninth Embodiment

Figure 9:
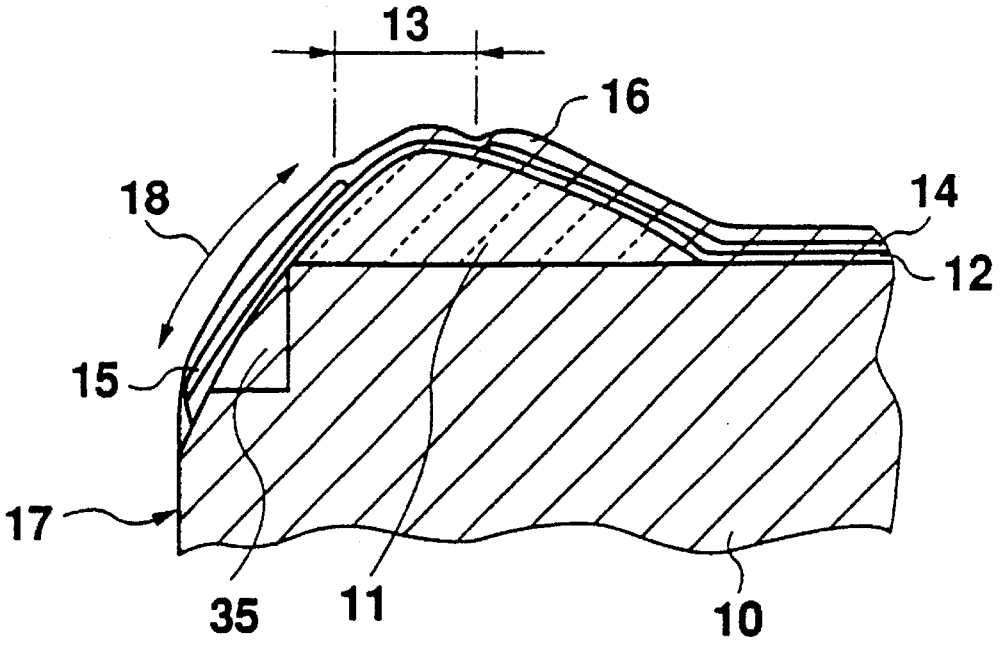
FIG. 9 sectional view of a corner head type thermal head according to a ninth embodiment of the invention.

A ninth embodiment of the invention is shown in FIG. 9.

The embodiment shown in FIG. 9 is characterized by the fact that the corner head type thermal head with the entire slope 18 formed as a convexly curved surface according to the first embodiment has a reinforcement conductor 35 along a common electrode 15 embedded below a resistance film layer 12 of a slope 18 as in the third embodiment.

Tenth Embodiment

Figure 10:
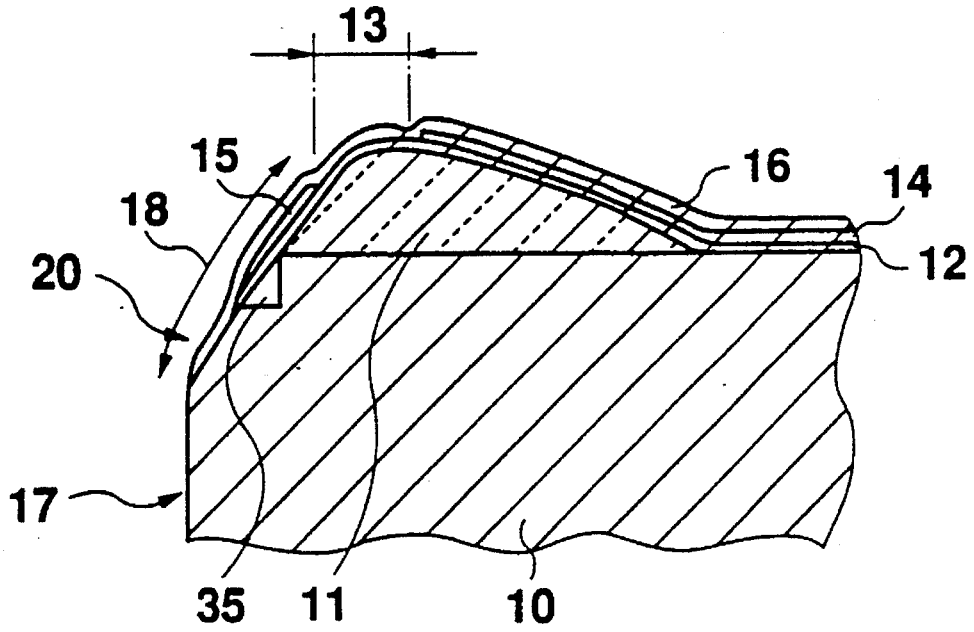
FIG. 10 is a sectional view of a corner head type thermal head according to a tenth embodiment of the invention.

A tenth embodiment of the invention is shown in FIG. 10.

The embodiment shown in FIG. 10 is characterized by the fact that the corner head type thermal head with the intersecting part 20 of the slope 18 and the side 17 of the substrate 10 formed as a convexly curved surface according to the second embodiment has a reinforcement conductor 35 along a common electrode 15 embedded below a resistance film layer 12 of a slope 18 as in the third embodiment.

Eleventh Embodiment

Next, a method of manufacturing the corner head type thermal head in the first embodiment is described. FIGS. 11 to 15 show the manufacturing steps of the thermal head.

Figure 11:
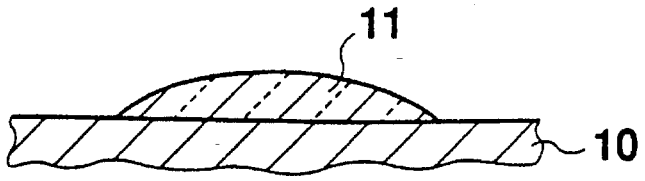
FIG. 11 is a process drawing showing a step in a manufacturing method of the corner head type thermal head in FIG. 1.

In the step shown in FIG. 11, a mountain-like glaze layer 11 is formed on the top surface of a substrate 10.

Figure 12:
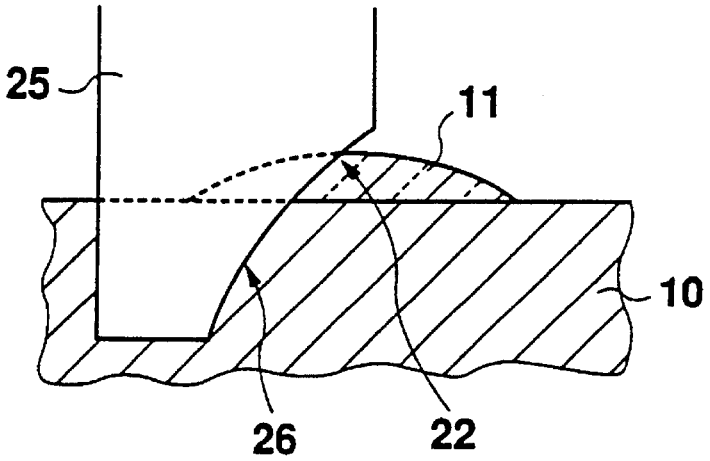
FIG. 12 is a process drawing showing a step in the manufacturing method of the corner head type thermal head in FIG. 1.

In the step shown in FIG. 12, the glaze layer 11 and the substrate 10 are half cut with a blade 25 so as to leave a part of the glaze layer 11 from the top surface of the glaze layer 11 to the substrate 10. The blade 25 has a slant part 26 as a part of the side, the slant part 26 being formed as a concavely curved surface. To half cut them, the glaze layer 11 is cut with the slant part 26, thereby forming a groove 21 (FIG. 13) having the inclined side constituted of the glaze layer 11 and the substrate 10.

The embodiment is characterized in that the glaze layer 11 side of the groove 21 formed by the half cutting is formed as a convexly curved surface.

Figure 13:
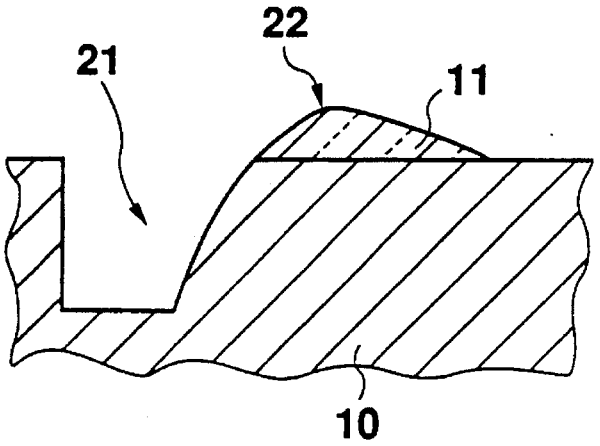
FIG. 13 process drawing showing a step in the manufacturing method of the corner head type thermal head in FIG. 1.

In the step shown in FIG. 13, the substrate 10 where the groove 21 is formed by the half cutting is heat-treated. Burrs produced on the top 22 of the glaze layer 11 by the half cutting are removed by the heat treatment for rounding the top 22. The top 22 will become the corner part 55 shown in FIG. 1. The glaze cut part on the face of the groove 21 formed by the half cutting is low in smoothness, but the smoothness of the face is also improved by the heat treatment. Thus, subsequent pattern formation is facilitated. Although not shown, the substrate 10 is a large substrate from which a large number of thermal heads can be provided, and a plurality of grooves 21 are formed.

Figure 14:
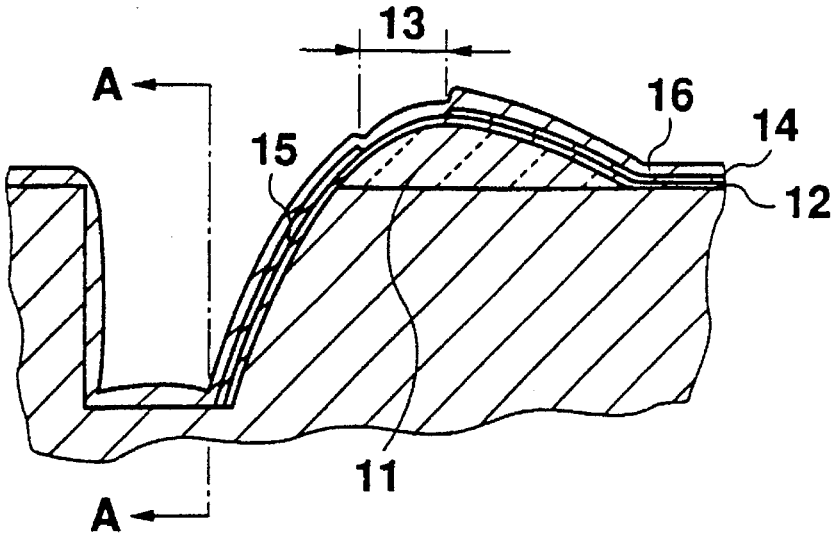
FIG. 14 is a process drawing showing a step in the manufacturing method of the corner head type thermal head in FIG. 1.

In the step shown in FIG. 14, films of a resistance film layer 12, a discrete electrode 14, and a common electrode are formed by a photo-lithography process. In this case, the discrete electrode 14 and the common electrode 15 are spaced out to form a heater area 13 in the vicinity of the top of the glaze layer 11.

Further, a protective film 16 is formed to protect the substrate before division as shown in FIG. 14.

Figure 15:
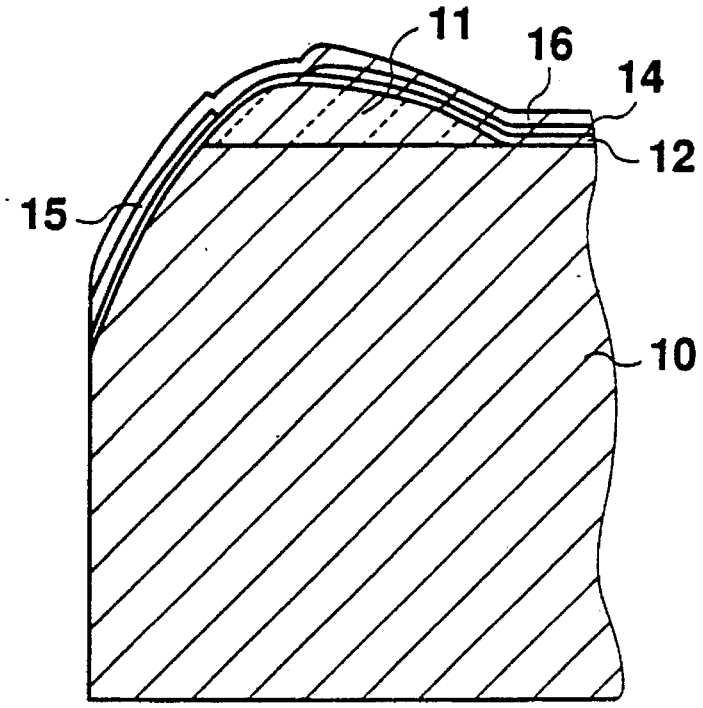
FIG. 15 is a process drawing showing a step in the manufacturing method of the corner head type thermal head in FIG. 1.

Lastly, the substrate is cut and divided along the A—A line shown in FIG. 14 to provide a separate thermal head shown in FIG. 15. The corner head type thermal head is now complete.

In the manufacturing method of the corner head type thermal head according to the invention described above, grooves 21 are formed by half cutting and a predetermined pattern is formed, then separate thermal heads are produced by cutting or cracking, whereby a large number of thermal heads can be prepared easily and simultaneously.

Figure 16:
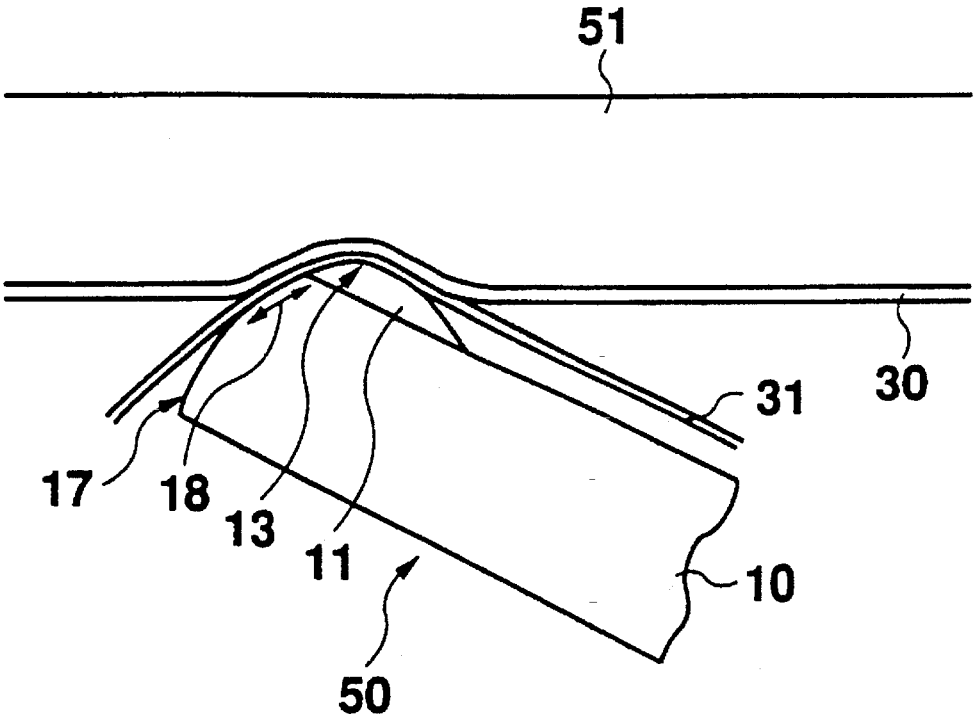
FIG. 16 is an illustration of a printing mechanism of a printer using the corner head type thermal head in FIG. 1.

FIG. 16 shows a printing mechanism of a printer using the corner head type thermal printer according to the first embodiment manufactured by the method according to the eleventh embodiment of the invention. Print paper 30 and a ribbon 31 are put between the glaze layer 11 and a platen 51 and printing is performed by heat generation of the heater area 13. The slope 18 is formed at the end of the thermal head and the entire slope 18 or the intersecting part of the slope 18 and the side 17 of the substrate 10 is formed as a convexly curved surface, so that the ribbon 31 is in sliding contact with the smooth face and can be prevented from being worn or cut.

Twelfth Embodiment

Figure 17A:
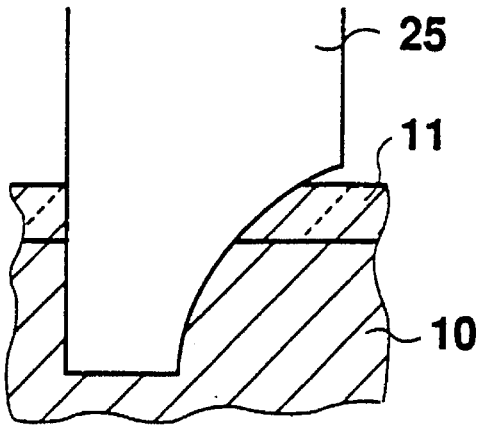
FIG. 17(*a*) is an illustration of a method of manufacturing a corner head type thermal head of full glaze type according to the invention.
Figure 17B:
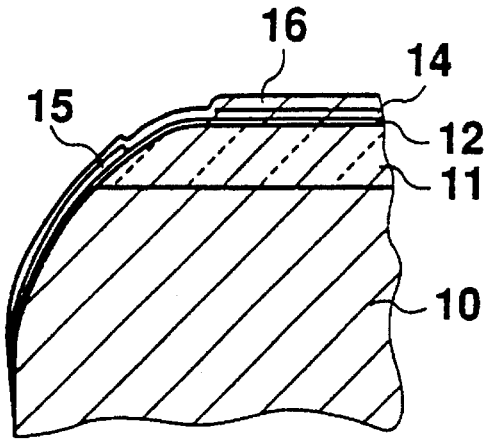

In the above-mentioned embodiments, examples in which a substrate of partial glaze type is used are discussed, but the method of manufacturing the thermal head according to the invention can also be applied to cases where a substrate of full glaze type is used. An example thereof is shown in FIG. 17(*a*),(*b*). As shown in FIG. 17 (*a*), a glaze layer 11 is formed fully on a substrate 10. The full glaze layer 11 is half cut with the above-mentioned blade 25, thereby forming a thermal head of the full glaze type with the end having a slope formed as a convexly curved surface, as shown In FIG. 17 (*b*).

Thirteenth Embodiment

Figure 18A:
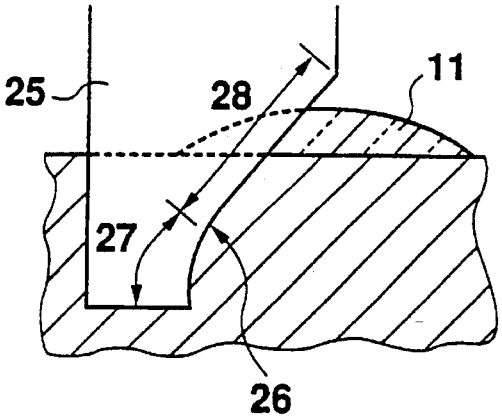
FIG. 18(*a*) is an illustration of a method of manufacturing the corner head type thermal head in FIG. 2.
Figure 18B:
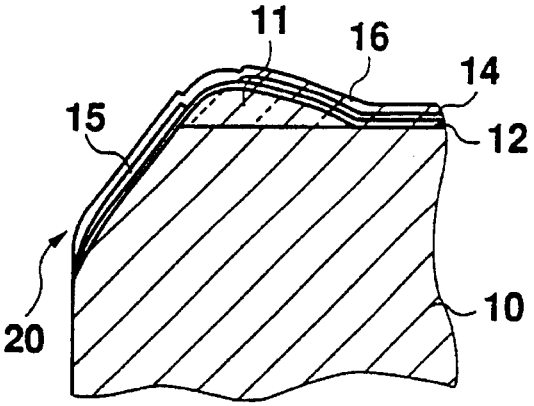

Next, to manufacture the corner head type thermal head shown in FIG. 2, a blade 25 of the form as shown in FIG. 18 (*a*) may be used for half cutting. A slant part 26 of the blade 25 consists of a nose 27 formed as a concavely curved surface and a linear part 28. The rest of the steps are the same as the steps shown in FIGS. 13 to 15 and the thermal head shown in FIG. 18 (*b*) is thus manufactured; it is the same as the thermal head shown in FIG. 2.

Fourteenth Embodiment

Figure 19:
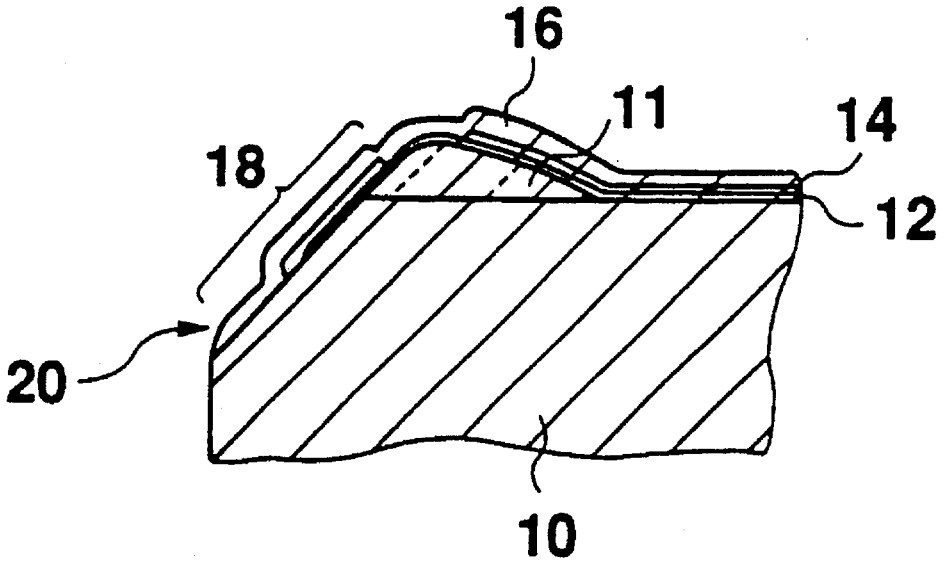
FIG. 19 is a sectional view of a corner head type thermal head according to a fourteenth embodiment of the invention.
Figure 20:
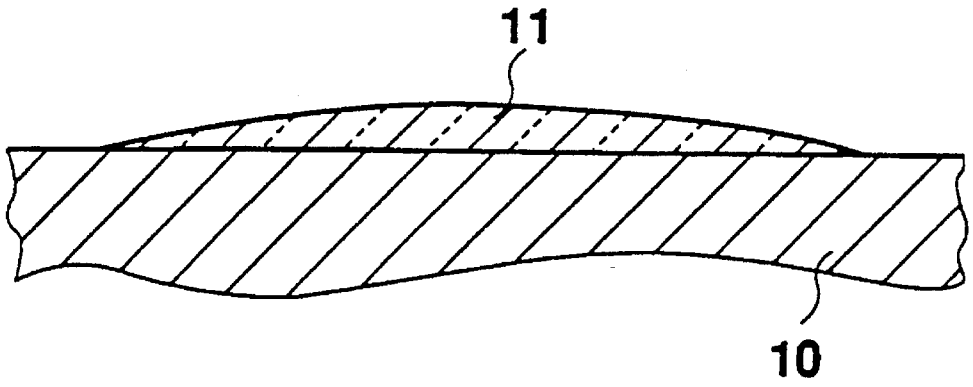
FIG. 20 is a process drawing showing a step in a manufacturing method of the corner head type thermal head in FIG. 3.

The fourteenth embodiment shown in FIG. 19 is similar to that shown in FIG. 2, but they differ in the forming method of forming the intersecting part 20. In the fourteenth embodiment, the slant part of a blade to be used (not shown) may consist of a linear part, and a slope 18 is formed by the above-mentioned method, then the intersecting part 20 of the slope 18 and the side 17 of a substrate 10 is ground for chamfering.

Fifteenth Embodiment

Next, a method of manufacturing the corner head type thermal head shown in FIG. 3 will be described.

FIGS. 20 to 25 show the manufacturing method of the thermal head. In the step shown in FIG. 20, the glaze layer 11 is formed on the substrate 10.

Figure 21:
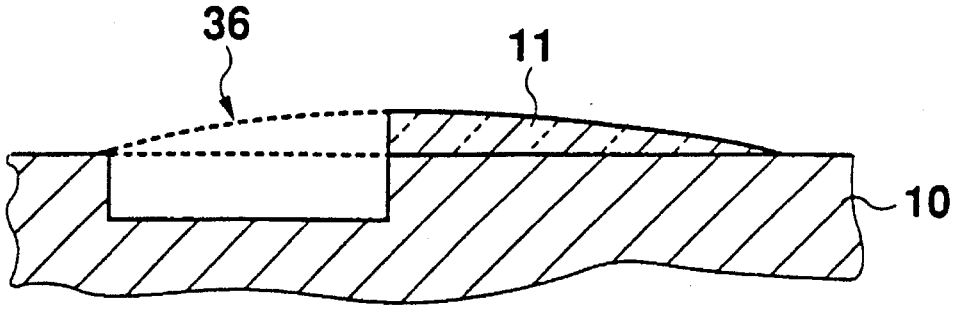
FIG. 21 is a process drawing showing a step in the manufacturing method of the corner head type thermal head in FIG. 3.

In the step shown in FIG. 21, a dicing blade is used to form a groove 36 reaching the substrate 10 from the top surface of the glaze layer 11.

Figure 22:
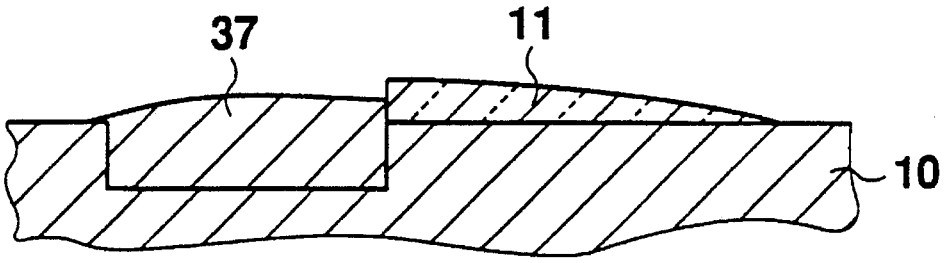
FIG. 22 is a process drawing showing a step in the manufacturing method of the corner head type thermal head in FIG. 3.

In the step shown in FIG. 22, conductor paste is embedded by printing or injection into the groove formed in the preceding step, and is calcined and hardened. The conductor paste 37 finally becomes the reinforcement conductor 35.

Figure 23:
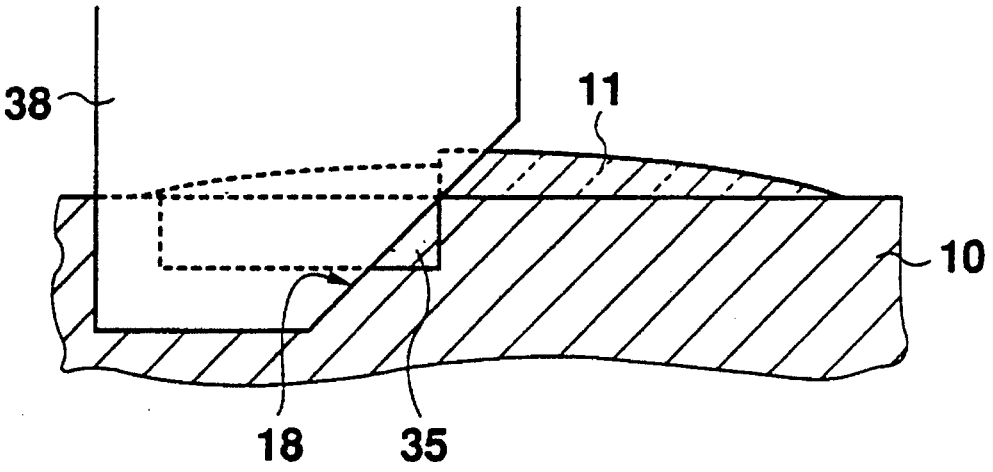
FIG. 23 is a process drawing showing a step in the manufacturing method of the corner head type thermal head in FIG. 3.

In the step shown in FIG. 23, a blade 38 with a slant part is used to half cut the glaze layer and the substrate so as to leave a part of the conductor paste 37 described in the preceding step for forming the slope 18 of the corner head type thermal head.

If a blade with the entire slant part formed as a concavely curved surface as shown in FIG. 12 is used as the blade 38, the slope 18 is formed entirely as a convexly curved surface, as shown in FIG. 9 (ninth embodiment). If a blade with the nose 27 formed as a concavely curved surface as shown in FIG. 18 (*a*) is used as the blade 38, the slope 18 is formed with the intersecting part 20 of the slope 18 and the side 17 of the substrate 10 formed as a convexly curved surface, as shown in FIG. 10 (tenth embodiment).

Figure 24:
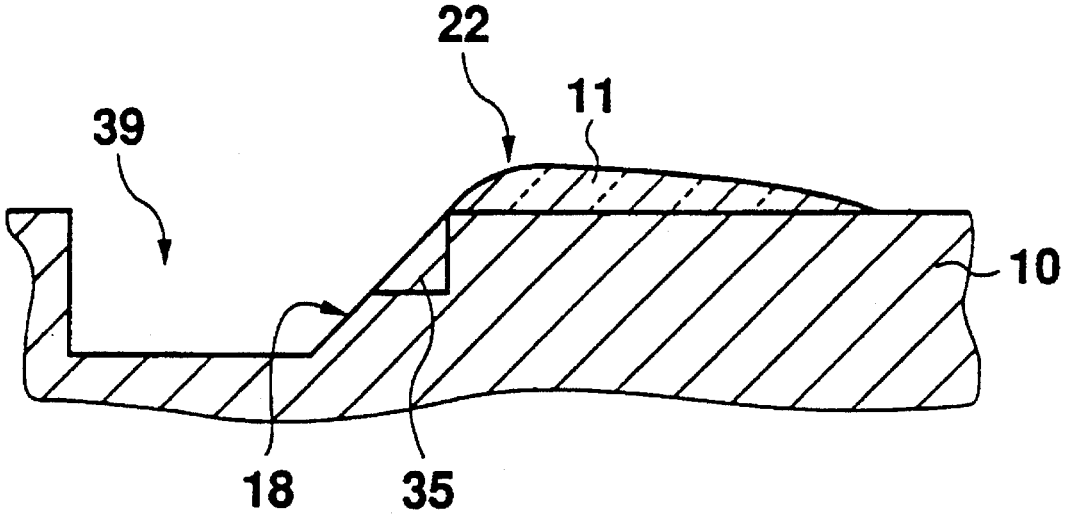
FIG. 24 is a process drawing showing a step in the manufacturing method of the corner head type thermal head in FIG. 3.

In the step shown in FIG. 24, the substrate 10 where the groove 39 is formed by the half cutting is chemically treated or heat-treated for rounding the top 22 and improving the smoothness of the glaze cut part, as in the eleventh embodiment.

A plurality of grooves 39 are formed as in the eleventh embodiment.

Figure 25:
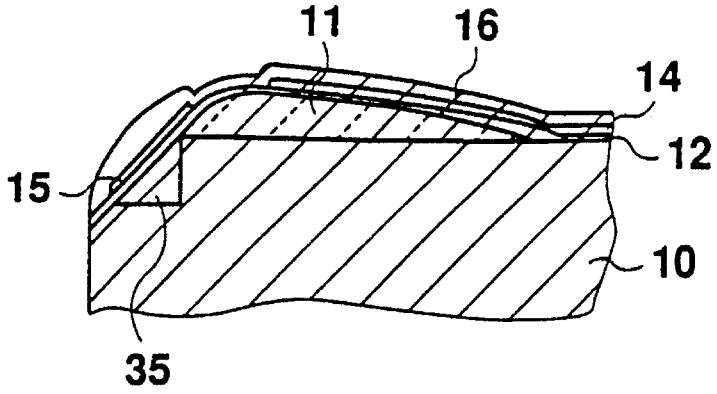
FIG. 25 is a process drawing showing a step in the manufacturing method of the corner head type thermal head in FIG. 3.

In the step shown in FIG. 25, the resistance film layer 12 and conductors to form electrodes 14 and 15 are formed by sputtering, etc., and the discrete electrode 14 and the common electrode 15 are patterned by photo-lithography.

Next, the protective film is sputtered and last the substrate is divided to complete a separate corner head type thermal head shown in FIG. 23.

The manufacturing method is characterized by the fact that the conductor paste 37 is embedded in the groove 36 formed by the half cutting and that the slope 18 is formed so as to leave a part of the conductor paste 37 with the blade 38 with a slant part, whereby the structure where the reinforcement conductor 35 is embedded in the slope 18 is provided.

Sixteenth Embodiment

Next, a method of manufacturing the seventh embodiment shown in FIG. 7 which differs from other embodiments in the sectional form of the reinforcement conductor 35 will be described. FIGS. 26 to 29 show the manufacturing method of the corner head type thermal head.

Figure 26:
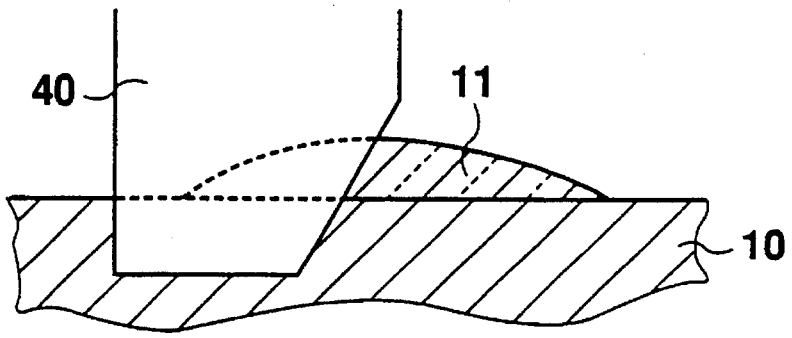
FIG. 26 is a process drawing showing a step in a manufacturing method of the corner head type thermal head in FIG. 7.

In the step shown in FIG. 26, a blade 40 with a slant part is used to form a groove reaching the substrate 10 from the top surface of the glaze layer 11. The side wall of the groove containing the glaze layer 11 is a slope.

Figure 27:
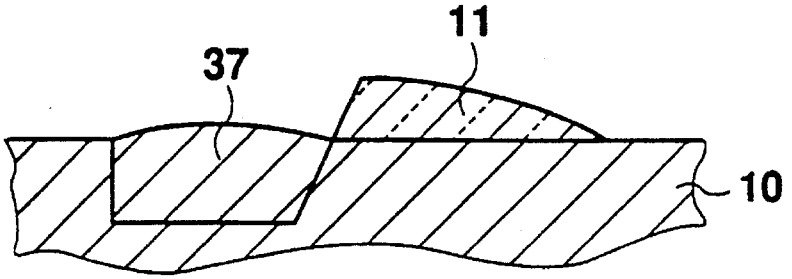
FIG. 27 is a process drawing showing a step in the manufacturing method of the corner head type thermal head in FIG. 7.

In the step shown in FIG. 27, conductor paste 37 is embedded in the groove as in the step shown in FIG. 22.

Figure 28:
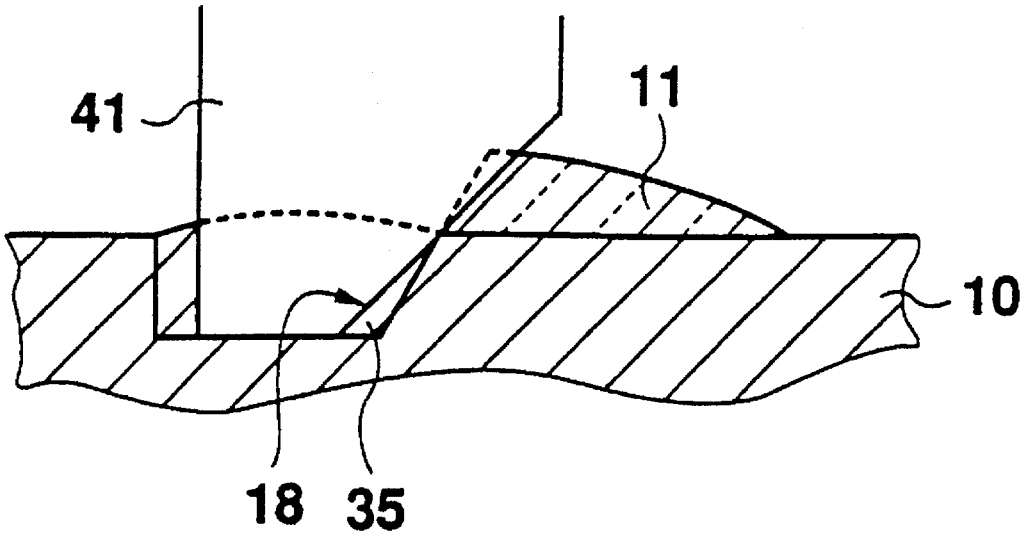
FIG. 28 is a process drawing showing a step in the manufacturing method of the corner head type thermal head in FIG. 7.

In the step shown in FIG. 28, a blade 41 having a slant part whose slant angle is larger than that of the slant part of the blade 40 used in the step shown in FIG. 26 is used to half cut the glaze layer and the substrate so as to leave a part of the conductor paste 37 described above for forming the slope 18 of the corner head type thermal head. In this case, the partially left conductor paste 37 becomes the reinforcement conductor 35.

Figure 29:
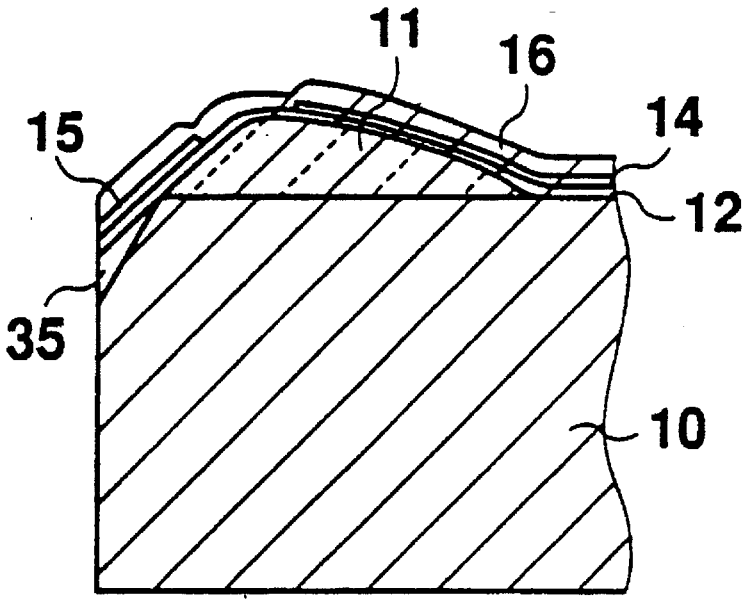
FIG. 29 is a process drawing showing a step in the manufacturing method of the corner head type thermal head in FIG. 7.
Figure 30:
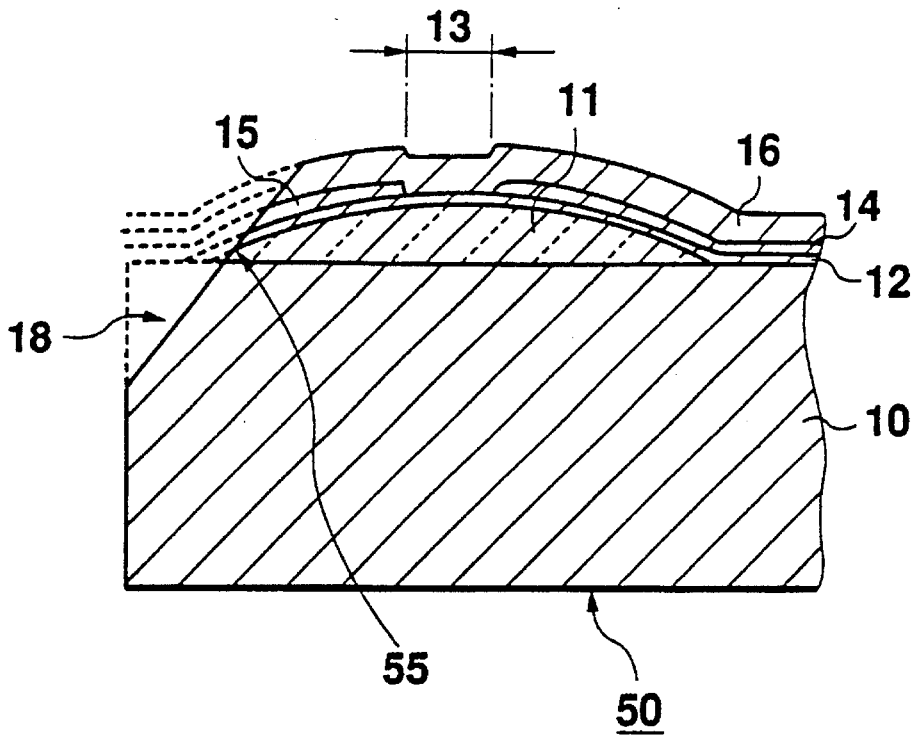
Fig. 30 PRIOR ART
FIG. 30 is a sectional view of an example of a conventional near edge type thermal head.
Figure 31:
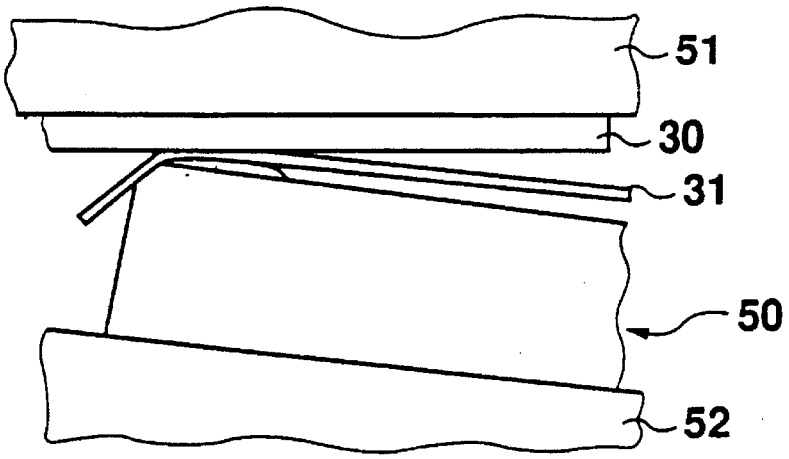
Fig. 31 PRIOR ART
FIG. 31 is an illustration of a printing mechanism of a printer using the near edge type thermal head in FIG. 30.

Subsequently, the steps as described in conjunction with FIGS. 23–25 are executed to complete the corner head type thermal head shown in FIG. 29.

What is claimed is:

1. A method of manufacturing a corner head type thermal head, comprising the steps of:

forming a glaze layer on a substrate;

preparing a cutting blade having a slant part with at least a neighborhood of a nose formed as a concavely curved surface;

half cutting said glaze layer and said substrate with said cutting blade downward from a predetermined position on a top surface of said glaze layer for forming a groove one side of which forms a slope being constituted of said glaze layer and said substrate, said slope being formed as a convexly curved surface in at least a vicinity of a bottom of said groove;

heat-treating said substrate and said glaze layer;

forming a resistance film layer, a common electrode, a discrete electrode, and a protective film on said glaze layer and on said slope; and cutting said substrate on both sides of said groove.

2. The method as claimed in claim 1 wherein the entire slant part of said cutting blade is formed as a concavely curved surface.

* * * * *